US005154581A

United States Patent [19]

Borufka et al.

[11] Patent Number: 5,154,581

[45] Date of Patent: Oct. 13, 1992

[54] SHROUD BAND FOR A ROTOR WHEEL HAVING INTEGRAL ROTOR BLADES

[75] Inventors: Hans P. Borufka, Munich; Helmut Gross, Esterhofen; Gerald Himmler, Karlsfeld, all of Fed. Rep. of Germany

[73] Assignee: Mtu Motoren- und Turbinen- Union Munchen GmbH, Munich, Fed. Rep. of Germany

[21] Appl. No.: 699,474

[22] Filed: May 13, 1991

[30] Foreign Application Priority Data

May 11, 1990 [DE] Fed. Rep. of Germany ..... 4015206

[51] Int. Cl.[5] ..... F01D 5/22

[52] U.S. Cl. ..... 416/190; 416/191; 415/173.6

[58] Field of Search ..... 415/173.1, 173.5, 173.6, 415/174.5, 139; 416/190, 191, 192

[56] References Cited

U.S. PATENT DOCUMENTS 2,945,673 7/1960 Hockert et al. ..... 415/139
4,576,551 3/1986 Olivier et al. ..... 415/173.6
4,623,298 11/1986 Hallinger et al. ..... 415/173.6
4,710,102 12/1987 Ortolano ..... 416/190
4,948,338 8/1990 Wickerson ..... 416/190
4,986,737 1/1991 Erdmann ..... 416/190

FOREIGN PATENT DOCUMENTS 39807 3/1977 Japan ..... 416/191

*Primary Examiner*—Thomas E. Denion
*Assistant Examiner*—Michael S. Lee
*Attorney, Agent, or Firm*—Ladas & Parry

[57] ABSTRACT

A shroud band for a rotor wheel having integral rotor blades wherein the shroud band has at least one Z-shaped separation gap at the band periphery, the Z-shaped gap having two parallel damping gaps which are axially spaced apart and which are inclined at an angle of from 70° to 90° relative to the axial direction. The damping gaps are narrow and are joined by an inclined wider free gap portion. During rotation, the damping gaps close up and the adjoining surfaces of the band come into frictional engagement whereas the free gap remains open.

17 Claims, 2 Drawing Sheets

FIG. 2
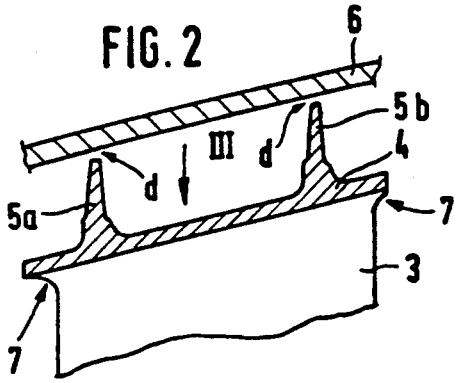
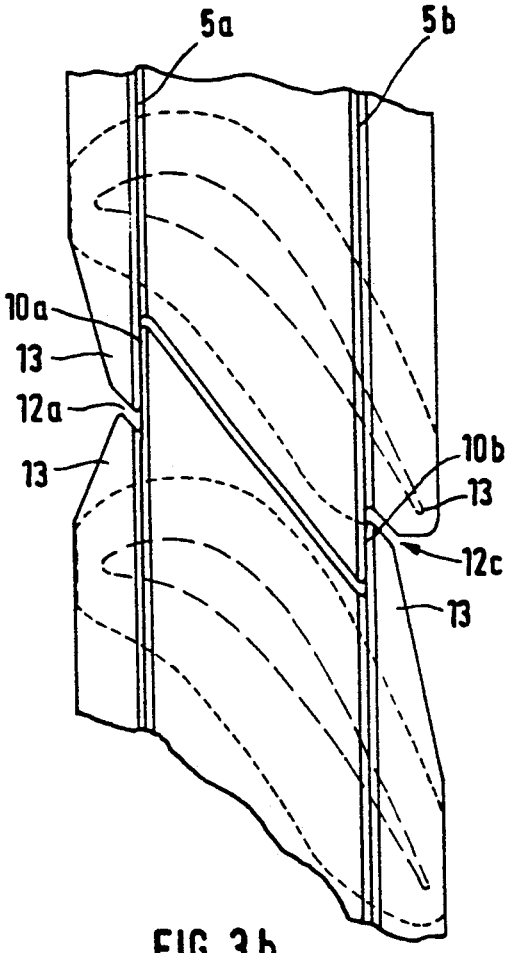
FIG. 3b
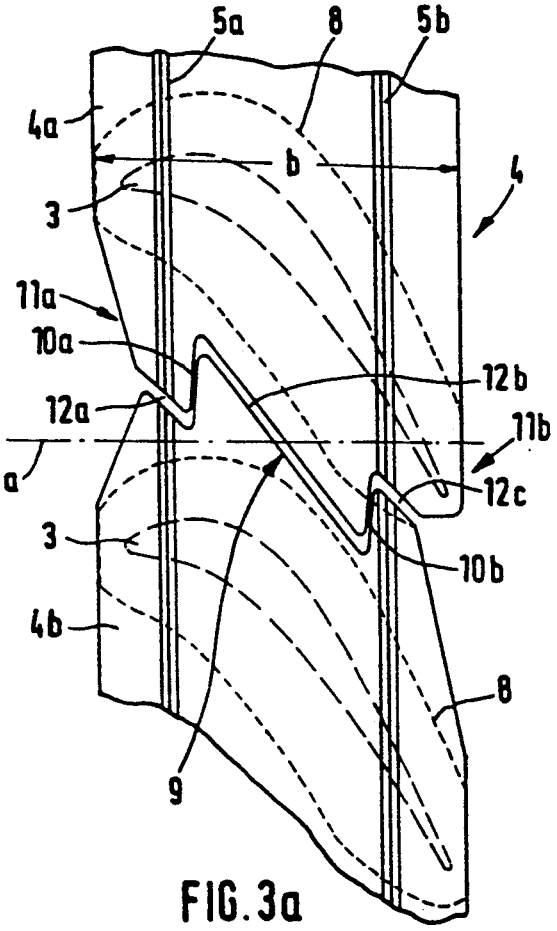
FIG. 3a

SHROUD BAND FOR A ROTOR WHEEL HAVING INTEGRAL ROTOR BLADES

FIELD OF THE INVENTION

The invention relates to a shroud band for a rotor wheel having integral rotor blades, the shroud band having at least one Z-shaped separation gap at the periphery of the blades, the Z-shaped separation gap having one part of relatively small gap width for damping purposes (damping gap) and another part of relative large gap width which remains open (free gap).

BACKGROUND AND PRIOR ART

In turbojet engines, the sealing gap between the rotating blades and the stationary engine housing represents a limiting variable which is of considerable importance for the efficiency of the engine. In order to minimize the sealing gap in turbines, it is known to provide the turbine with a shroud band which is attached to the blade tips. In the case of turbines with individually attached blades or blades attached in groups, the shroud band comprises band portions attached to the blades and having adjacent surfaces in toothed engagement with one another.

A shroud band constructed in this way is not possible with a turbine wheel having integral rotor blades. Conventional shroud bands for turbine wheels with integral rotor blades have a number of separation gaps for every three to five blades to compensate for expansions occurring during intermittent operation and to avoid development of additional stresses in the already highly stressed blades. These separation gaps extend substantially parallel to the chord lines of the adjacent blades in order to disconnect the shroud band from the blade tips in a way to minimize stress at the connection of the shroud band to the blade tips. In addition the separation gaps are formed with a short middle portion extending substantially at right angles to two end portions, so that the gaps have a substantially Z-shaped outline. The middle gap portion has a small width which is intended to be taken up, in operation, by thermal expansion, so that the adjacent shroud band portions are frictionally engaged at the middle portions of the gaps. In this way, vibration of the blades and of the shroud band portions connected thereto are effectively damped by friction, in which case the vibrations are additionally de-tuned. The two end or lateral portions of the gap (so-called free gaps) joined to the middle portion of the gap have sufficiently wide gap widths so that contact does not occur there under any conditions.

The conventional shroud band construction has the disadvantage that the individual middle gap portions cannot be produced with the small gap width desired to achieve optimum operating conditions, since the cutting tools used must have adequate rigidity and consequent thickness. For manufacturing reasons it is only possible to produce a finite gap which cannot be made less than from about 0.2 to 0.3 mm. This results in poorer damping and de-tuning characteristics of the vibrations which are developed. Consequently, vibrations of large amplitude occur, resulting in considerable stressing of the materials of the blades and shroud band.

SUMMARY OF THE INVENTION

An object of the invention is to provide an improved shroud band of the type described such that, on the one hand, an unrestricted peripheral or circumferential displacement of the shroud band portions is possible, so as to achieve compensation of thermal expansion with minimal stress and, on the other hand, the separation gap in the portions in contact during operation are made so narrow to provide adequate frictional damping of the vibrations. In addition, the shroud band is independent of different expansions of the rotor disc, i.e. is free on the periphery of the blade tips.

This object is attained according to the invention in that two damping gaps are provided which are axially spaced apart and which are oriented at an angle of from 70° to 90° relative to the axis of rotation of the rotor. The angle preferably is from 80° to 85°.

The essential advantages of the invention are that, while retaining an unchanged size of contact area between adjacent shroud band portions, a narrower gap is present and a stiffening of the arrangement is possible, since the frictional contact through the two parallel faces is possible. As a whole, the vibrations occurring in the several blades connected by a respective shroud band portion are effectively damped, since the damping gap is formed in such a way that pressure contact occurs during operation. This very narrow damping gap is advantageously independent of the circumferential expansion of the shroud band.

The increase in the angle of the two damping gaps with respect to the axis of rotation of the rotor to a value of between 70° and 90° has the effect that the circumferential expansion of the shroud band occurring, for example, during acceleration of the engine can take place without obstruction. In addition, peripheral or circumferential expansion affects the damping effect at the damping gap only slightly, i.e. the damping action is substantially independent of the operating condition of the turbine.

A further advantage is that the twisting of the blades occurring during operation due to centrifugal forces can be utilized to produce an effective reduction of the damping gap or the development of a damping thrust force, since according to the invention the angle of the damping gaps has such a large value.

In addition, it is advantageous that the very narrow damping gap can be made easier and more precise by doubling the number of damping gaps and thereby halving the length of each of the two damping gaps, which in turn leads to optimization of the shroud band portions by the shorter length of the damping gaps.

An advantageous further development of the invention provides that two continuous sealing lips spaced apart axially are integrally formed on the outer periphery of the band portions, and the damping gaps are arranged in the sealing lips. Radial sealing lips extending circumferentially around the shroud band are known, in order to define a remaining sealing gap between the shroud band and the outer housing of the flow duct, and fluid flow through the sealing gaps can be minimized by the spaced arrangement of the sealing lips one behind the other. In the event of a separation of the sealing lips, gaps or spaces are formed in the sealing lips, so that fluid can flow through the lips as well as through the separation gap between the lips and the housing. By virtue of the arrangement according to the invention in which the damping gaps extend in the sealing lips, these damping gaps are substantially reduced, or eliminated during operation. This advantageously results in a reduced fluid flow through the shroud band.

A further advantageous embodiment of the shroud band provides that the free gap portions in the region of the side edges of the shroud band are substantially widened in the manner of a wedge. In this way, overhang of the shroud band portions in the vicinity of the end regions of the free gaps, which are susceptible to vibration, can be reduced, so as to reduce the risk of vibration cracks of the shroud band.

BRIEF DESCRIPTION OF THE FIGURES OF THE DRAWING

The invention is further described with reference to two preferred embodiments illustrated in the attached drawing, in which:

FIG. 2 is an enlarged view of detail II in FIG. 1;

FIG. 3*a* is a plan view of one embodiment of a shroud band according to the invention as seen in the direction of arrow III in FIG. 2; and FIG. 3*b* is a plan view of another embodiment of the shroud band according to the invention.

DETAILED DESCRIPTION

Figure 1:
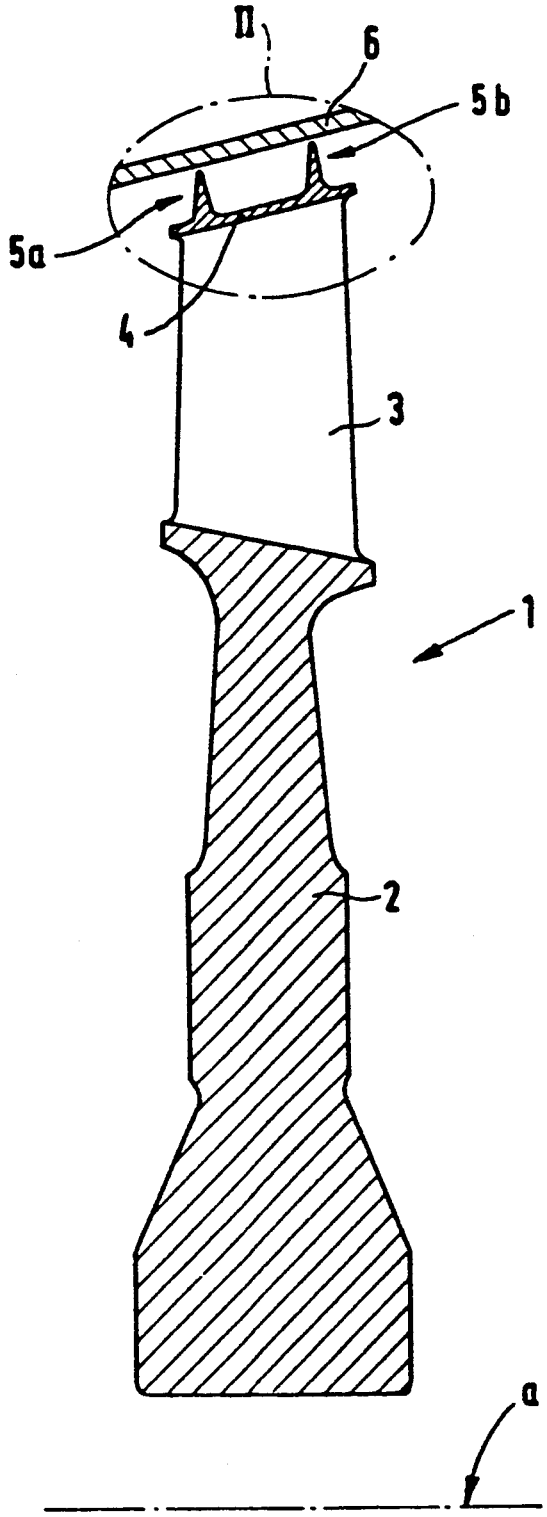
FIG. 1 is a cross-section through a portion of a turbine having integral rotor blades.

FIG. 1 shows in cross-section a turbine wheel 1 rotatable around an axis of rotation a, which essentially comprises a turbine disc 2 with integral blades 3 distributed around the periphery of the disc and a shroud band 4 integrally molded on the tips of the blades. The shroud band 4 comprises two axially spaced sealing lips 5*a* and 5*b*, which project radially outwards from a base portion of the band and define narrow sealing gaps with an outer casing 6 of the turbine. In FIG. 2 the sealing gaps are seen at d.

FIG. 3*a* shows a portion of the shroud band 4 as viewed in the direction of arrow III in FIG. 2. FIG. 3*a* shows two adjacent shroud band portions 4*a* and 4*b*, each of which is integrally molded on the tips of a plurality of respective blades 3, preferably three or four in number. In order that the stresses produced by the high centrifugal force in the transition regions 7 between the shroud band 4 and the blades 3 may be kept low, the blades are formed with regions 8 of large radii as shown by the boundary lines in FIG. 3*a*.

The adjoining surfaces of the edges of adjacent shroud band portions 4*a* and 4*b* define a separation gap 9 which essentially comprises two axially spaced damping gaps 10*a* and 10*b* and free gaps 12*a*, 12*b* and 12*c*. Free gap 12*b* extends between gaps 10*a* and 10*b* and gaps 12*a* and 12*c* extend from gaps 10*a* and 10*b* respectively towards the lateral side edges 11*a* and 11*b* of the shroud band. The free gaps 12*a*, 12*b* and 12*c* have widths of from about 0.6 to 0.8 mm, while the damping gaps 10*a* and 10*b* have widths of about 0.1 mm in the cold state.

During operation, the damping gaps 10*a* and 10*b* are normally completely closed, i.e. the shroud band portions 4*a* and 4*b* are frictionally engaged at these gaps whereas the free gaps 12*a*, 12*b* and 12*c* remain open.

The middle free gap 12*b*, which is situated between the two damping gaps 10*a* and 10*b*, is oriented substantially at an angle of 45° with respect to the axial direction a. The other free gaps 12*a* and 12*c* advantageously have substantially the same orientation. The damping gaps 10*a* and 10*b*, on the other hand, are oriented substantially at an angle of from 70° to 90° with respect to the axial direction a, and preferably at an angle of from about 80° to 85° to achieve the advantages according to the invention. The two damping gaps 10*a* and 10*b* are each located at a distance of substantially ¼ of the width b of the shroud band 4 from the side edges 11*a* and 11*b* of the shroud band. The free gap 12*b* extends between the damping gaps 10*a*, 10*b* in inclined relation thereto to form a Z-shape therewith.

The embodiment of the shroud band illustrated in FIG. 3*b* differs from the embodiment in FIG. 3*a* in that the two damping gaps 10*a* and 10*b* extend in the sealing lips 5*a* and 5*b*. This has the advantage that the gaps between adjacent portions of the sealing lips can be eliminated, during operation, by take-up of the gap width of the damping gaps 10*a* and 10*b*.

The end areas of the outer free gaps 12*a* and 12*c* at the side edges 11*a* and 11*b* are substantially enlarged in the manner of a wedge, so that overlying platform regions 13 of the band portions (which have a pronounced tendency to vibrate during operation) are reduced in size, without adversely affecting the operation of the shroud band 4. In this way, the mass of the unsupported platform regions is advantageously reduced.

Although the invention has been described in relation to specific embodiments thereof, it will become apparent to those skilled in the art that numerous modifications and variations can be made as disclosed in the attached claims.

What is claimed is:

1. A shroud band for a rotor wheel having a disc with a plurality of integral rotor blades extending circumferentially around this disc, the rotor wheel being rotatable about an axis of rotation, said shroud band comprising a plurality of band elements each secured to a respective plurality of rotor blades at tips thereof, adjacent band elements having adjoining facing edge surfaces forming Z-shaped separation gaps therebetween, each Z-shaped separation gap having two substantially parallel parts axially spaced from one another joined by an inclined part, said parallel parts of each Z-shaped gap extending at an angle of 70° to 90° with respect to said axis of rotation of the rotor wheel, the facing surfaces of the adjacent band elements at said parallel parts of said gap being relatively closely spaced as compared to the spacing of said surfaces in said inclined part of said gap.

2. A shroud band as claimed in claim 1 wherein said inclined part of said gap extends at an angle with respect to said axis of rotation of said wheel.

3. A shroud band as claimed in claim 2 wherein said band elements have side edges disposed circumferentially around said axis of rotation, said separation gap including inclined parts extending between said side edges an said parallel parts of said separation gap.

4. A shroud band as claimed in claim 2 wherein each band element includes a base portion affixed to the tips of the associated plurality of rotor blades, and to continuous sealing lips projecting radially from said base potion and extending circumferentially along the band element from one edge surface to the other.

5. A shroud band as claimed in claim 4 herein said parallel parts of the Z-shaped gaps extend in said sealing lips.

6. A shroud band as claimed in claim 1 herein said parallel parts of said Z-shaped gap have a width of less than 0.1 mm.

7. A shroud band as claimed in claim 6 herein said inclined part of the Z-shaped gap has a width of 0.6 to 0.8 mm.

8. A shroud band as claimed in claim 1 wherein said band elements have side edges disposed circumferentially around said axis of rotation, adjoining facing edge surfaces of adjacent band elements defining further gaps extending from the parallel parts of the Z-shaped gap to said side edges.

9. A shroud band as claimed in claim 8 wherein said further gaps are parallel to said inclined part of said Z-shaped gap.

10. A shroud band as claimed in claim 8 wherein said further gaps extend at an angle of 45° with respect to said axis of rotation of the wheel.

11. A shroud band as claimed in claim 8 wherein said band elements form wedge-shaped openings extending in widening fashion from said further gaps to said side edges.

12. A shroud band as claimed in claim 1 wherein said parallel parts of each Z-shaped gap have centers disposed approximately at a distance of about ¼ of the width of the band from the side edges of said band.

13. A shroud band as claimed in claim 1 wherein said angle of the parallel parts of each Z-shaped gap relative to the axis of rotation is between 80° and 85°.

14. A shroud band as claimed in claim 1 wherein said inclined part of said gap extends at an angle of about 45° relative to said axis of rotation.

15. A shroud band as claimed in claim 1 wherein said parallel parts of the Z-shaped gap are dimensioned to be closed during rotation of the rotor wheel and produce frictional effects whereas said inclined part of the Z-shaped gap is dimensioned to remain open during rotation o the rotor wheel.

16. A shroud band as claimed in claim 1, wherein said shroud band has side edges and said parallel parts of the separation gap are axially spaced from said side edges.

17. A shroud band as claimed in claim 16, wherein said parallel parts of each separation gap are substantially equally spaced from said side edges.

* * * * *